US005641387A

United States Patent [19]

Baldini

[11] Patent Number: 5,641,387

[45] Date of Patent: Jun. 24, 1997

[54] ON-LINE COATER APPARATUS

[75] Inventor: Giorgio Baldini, Turin, Italy

[73] Assignee: Beloit Technologies, Inc., Wilmington, Del.

[21] Appl. No.: 401,661

[22] Filed: Mar. 9, 1995

Related U.S. Application Data

[63] Continuation of Ser. No. 98,563, Jul. 26, 1993, abandoned, which is a continuation of Ser. No. 613,591, Nov. 15, 1990, abandoned.

[30] Foreign Application Priority Data

Nov. 16, 1989 [EP] European Pat. Off. ..... 89121226

[51] Int. Cl.[6] ..... D21H 23/22

[52] U.S. Cl. ..... 162/265; 162/136; 162/286; 34/117

[58] Field of Search ..... 162/135, 136, 162/193, 194, 206, 255, 265, 286, 290, 359.1, 381; 34/113, 117, 120

[56] References Cited

U.S. PATENT DOCUMENTS

| | | | |
|---|---|---|---|
| 2,281,340 | 4/1942 | Thiele et al. | 162/265 |
| 3,723,169 | 3/1973 | Guastella et al. | 117/111 |
| 4,728,396 | 3/1988 | Alheid | 162/193 |
| 4,793,899 | 12/1988 | Skaugen | 162/360.1 |
| 4,874,470 | 10/1989 | Skaugen | 162/359 |
| 4,945,655 | 8/1990 | Wedel | 162/194 |

FOREIGN PATENT DOCUMENTS 1370915 7/1964 France .

*Primary Examiner*—Karen M. Hastings

*Attorney, Agent, or Firm*—Dirk J. Veneman; Raymond W. Campbell; David J. Archer

[57] ABSTRACT

An on-line coater apparatus is disclosed for coating a web of paper. The apparatus includes a dryer section having a plurality of single-tier dryer groups, each successive group drying an alternate side of the web, the web being restrained against cross-machine directional shrinkage during passage through the plurality of dryer groups. A further single-tier dryer group is disposed downstream relative to the plurality of groups such that the web extends in an open draw between the plurality of groups and the further group. A tail cutter is disposed adjacent to the open draw for cutting a tail from the web for subsequent threading through the further group. A calender is disposed downstream relative to the further group for calendering the dried web. A coater is disposed downstream relative to the calender for coating one side of the web, and a single-tier coating dryer group is disposed downstream relative to the coater for drying the coated one side of the web. A winder is disposed downstream relative to the coating dryer group for winding the coated web.

6 Claims, 2 Drawing Sheets

ON-LINE COATER APPARATUS

This is a continuation of application Ser. No. 08/098,563 filed on Jul. 26, 1993, now abandoned, which is a continuation of application Ser. No. 07,613,519 filed Nov. 15, 1990 now abandoned.

BACKGROUND OF THE INVENTION

1. Field of the Invention

The present invention relates to a coater apparatus for coating a web of paper. More specifically, the present invention relates to a coater apparatus having a coater and a single tier coating dryer group disposed downstream relative to the coater.

2. Information Disclosure Statement

With the introduction of the Total BelRun dryer arrangement, which became operational in Leykam, Austria, in 1989, the speed at which the web could be dried was greatly increased.

More specifically, the Total BelRun dryer section arrangement includes a plurality of single-tier drying groups with each successive group drying an alternate side of the web. Furthermore, the web is transferred between adjacent groups without open draw and the web proceeds through the drying section while being restrained against cross-machine directional shrinkage, thereby inhibiting cockle and curl of the resultant dried web.

Dryer sections located after coaters in the prior art utilize dryer sections with a series of open draws. The web in these open draws is susceptible to sheet flutter, cross-machine directional shrinkage, cockle and curl. The aforementioned problems are similar to the problems experienced in the open draw dryer sections of conventional main dryer groups which utilize two tier dryer arrangements.

In many applications, it is necessary to coat the dried web as a continuous operation. Although off-line coaters have been proposed in which the dried web is calendered and wound in preparation for subsequent batch mode coating, the present invention provides an on-line or constant run coater of compact configuration which permits coating of one or both sides of the dried, calendered web prior to final winding thereof.

More specifically, although on-line coaters have been previously used in the manufacture of coater papers, Applicant is unaware of an on-line or constant run coater apparatus which includes a single-tier coating dryer group disposed downstream relative to the coater.

A constant run coater otherwise known as an on-machine or on-line coater apparatus of the aforementioned type is described at column 1, lines 20–40, in U.S. Pat. No. 4,728,396 to R. J. Alheid by way of contrast to the off-line coater claimed in U.S. Pat. No. 4,728,396.

Therefore, it is a primary object of the present invention to provide an on-line or constant run coater apparatus for coating a web of paper that overcomes the aforementioned inadequacies of the prior art designs and which provides a coater apparatus of compact dimensions, thereby reducing the cost of manufacture thereof.

Another object of the present invention is the provision of an on-line coater apparatus which includes a tail cutter disposed upstream relative to a calender so that a downstream coater can be threaded on-line.

Another object of the present invention is the provision of an on-line coater which includes a single-tier coating dryer group which is disposed downstream relative to a coater for drying one side of the web, the apparatus also including a further single-tier coating dryer group disposed downstream relative to the single-tier coating dryer group such that the web extends in open draw therebetween, thereby permitting a further tail to be cut from the web for subsequent threading through a further coater.

Other objects and advantages of the present invention will be readily apparent to those skilled in the art by a consideration of the detailed description taken in conjunction with the annexed drawings.

SUMMARY OF THE INVENTION

The present invention relates to an on-line coater apparatus and method for coating a web of paper. The apparatus includes a dryer section. The dryer section comprises a plurality of single-tier dryer groups with each successive group drying an alternate side of the web. The web is restrained against cross-machine directional shrinkage during passage of the web through the plurality of dryer groups. A further single-tier dryer group is disposed downstream relative to the plurality of groups such that the web extends in an open draw between the plurality of groups and the further group. A tail cutter is disposed adjacent to the open draw for cutting a tail from the web for subsequent threading through subsequent sections.

A calender is disposed downstream relative to the further group for calendering the dried web, and a coater is disposed downstream relative to the calender for coating one side of the web.

A single-tier coating dryer group is disposed downstream relative to the coater for drying the coated one side of the web, and a reel is disposed downstream relative to the coating dryer group for winding the coated web.

In a more specific embodiment of the present invention, the plurality of single-tier dryer groups includes a first single-tier dryer group. The first dryer group includes a plurality of vacuum transfer rolls with each vacuum transfer roll of the plurality of vacuum transfer rolls being disposed adjacent to a dryer of the first dryer group such that the web extends in sinusoidal configuration alternately past a dryer and a vacuum transfer roll of the first dryer group.

The on-line coater also includes a dryer felt cooperating with the first dryer group such that the first dryer group is top felted so that in the event of a web breakage, broke can be removed downwardly from the first dryer group.

The on-line coater apparatus also includes a press section which is disposed upstream relative to a main dryer section. A dryer transfer means is disposed between the press section and the main dryer section for transferring the web from the press section to the dryer section. The dryer transfer means includes the dryer felt and a transfer roll. The transfer roll and the dryer felt define therebetween a web transfer section for guiding the web from the press section towards a first dryer of the dryer section.

The further single-tier dryer group also includes a further felt which extends in sinusoidal configuration around the further single-tier dryer group such that the further single-tier dryer group is top felted.

In a specific embodiment of the present invention, the coater is a short-dwell coater.

The single-tier coating dryer group also includes a coater felt which extends in sinusoidal configuration around each dryer of the coating dryer group such that the single-tier coating dryer group is bottom felted.

In a preferred embodiment of the present invention, the on-line coater apparatus for coating a web of paper includes a dryer section with the dryer section including a plurality of single-tier dryer groups. Each successive group dries alternate sides of the web. The web is restrained against cross-machine directional shrinkage during passage of the web through the plurality of dryer groups. A further single-tier dryer group is disposed downstream relative to the plurality of groups such that the web extends in an open draw between the plurality of groups and the further group. A tail cutter is disposed adjacent to the open draw for cutting a tail from the web for subsequent threading through the further group. A calender is disposed downstream relative to the further group for calendering the dried web. A coater is disposed downstream relative to the calender for coating one side of the web. A single-tier coating dryer group is disposed downstream relative to the coater for drying the coated one side of the web.

A further single-tier coating dryer group is disposed downstream relative to the single-tier coating dryer group such that the coated web extends in a further open draw between the single-tier coating dryer group and the further single-tier coating dryer group.

A further tail cutter means is disposed adjacent to the further open draw for cutting a further tail from the web for subsequent threading through the further single-tier coating dryer group.

A further coater is disposed downstream relative to the further single-tier coating dryer group for coating a second side of the web.

A winding means is disposed downstream relative to the further coater for winding the coated web.

The further single-tier coating dryer group also includes a further coater felt which extends in sinusoidal configuration around the further single-tier coating dryer group such that the further single-tier coating dryer group is top felted.

More specifically, the further coater is a short-dwell coater and the on-line coater apparatus further includes a plurality of single-tier coating dryer groups disposed downstream relative to the further coater, each successive coating dryer group drying an alternate side of the web.

The present invention also includes an on-line method of coating a web. The method comprises the steps of guiding the web through a plurality of single-tiered dryer groups such that each successive group dries an alternate side of the web, the web being restrained against cross-machine directional shrinkage during passage through the plurality of dryer groups; moving the web through an open draw between the plurality of single-tier dryer groups and a further single-tier group disposed downstream relative to the plurality of groups; cutting a tail from the web during passage of the web through the open draw; threading the tail through the further group; calendering the web downstream relative to the further group; coating one side of the web during passage of the web through a coater disposed downstream relative to the calender; guiding the coated web through a single-tier coating dryer group disposed downstream relative to the coater for drying the one side of the web; and winding the web downstream relative to the coating dryer group.

Many modifications and variations of the present invention will be readily apparent to those skilled in the art by a consideration of the detailed description taken in conjunction with the annexed drawings. However, such modifications and variations do not depart from the spirit and scope of the present invention as defined by the appended claims.

Included in such modifications is the provision of the aforementioned arrangement as applied to an off-line.

DETAILED DESCRIPTION OF THE DRAWINGS

Figure 1:
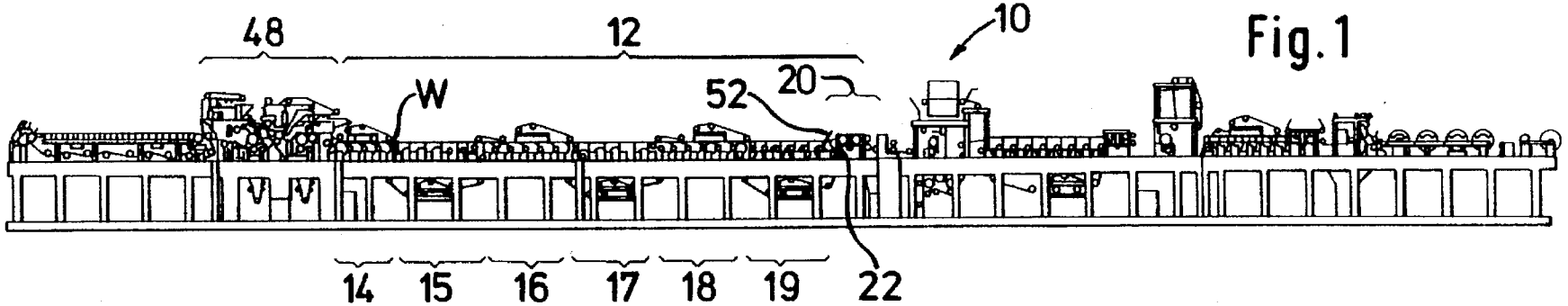
FIG. 1 is a side-elevational view of the on-line coater apparatus according to the present invention.

FIG. 1 is a side-elevational view of an on-line coater apparatus generally designated 10 for coating a web of paper W according to the present invention. The apparatus 10 comprises a dryer section generally designated 12. The dryer section 12 includes a plurality of single-tier dryer groups generally designated 14, 15, 16, 17, 18 and 19. Each successive group of the plurality of groups 14 to 19 dries an alternate side of the web W. The web W is restrained against cross-machine directional shrinkage during passage through the plurality of dryer groups 14 to 19.

A further single-tier dryer group generally designated 20 is disposed downstream relative to the plurality of groups 14 to 19 such that the web W extends in an open draw 22 between the plurality of groups 14 to 19 and the further group 20.

Figure 2:
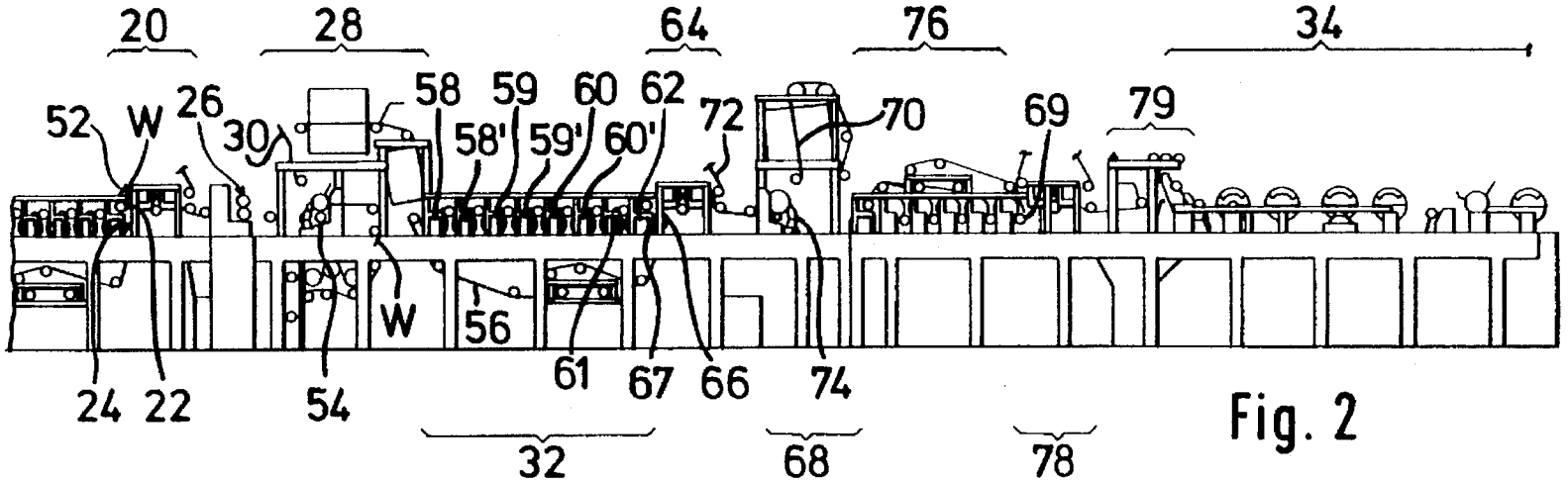
FIG. 2 is an enlarged view of the coater and further coater shown in FIG. 1.

FIG. 2 is an enlarged view of the further dryer group 20 shown in FIG. 1. FIG. 2 shows a tail cutter means 24 disposed adjacent to the open draw 22 for cutting a tail (not shown) from the web W for subsequently threading through the further group 20 or subsequent sections.

Calender means generally designated 26 is disposed downstream relative to the further group 20 for calendering the dried web W.

A coater generally designated 28 is disposed downstream relative to the calender means 26 for coating one side 30 of the web W.

A single-tier coating dryer group generally designated 32 is disposed downstream relative to the coater 28 for drying the coated one side 30 of the web W.

A winding means generally designated 34 is disposed downstream relative to the coating dryer group 32 for winding the coated web.

Figure 3:
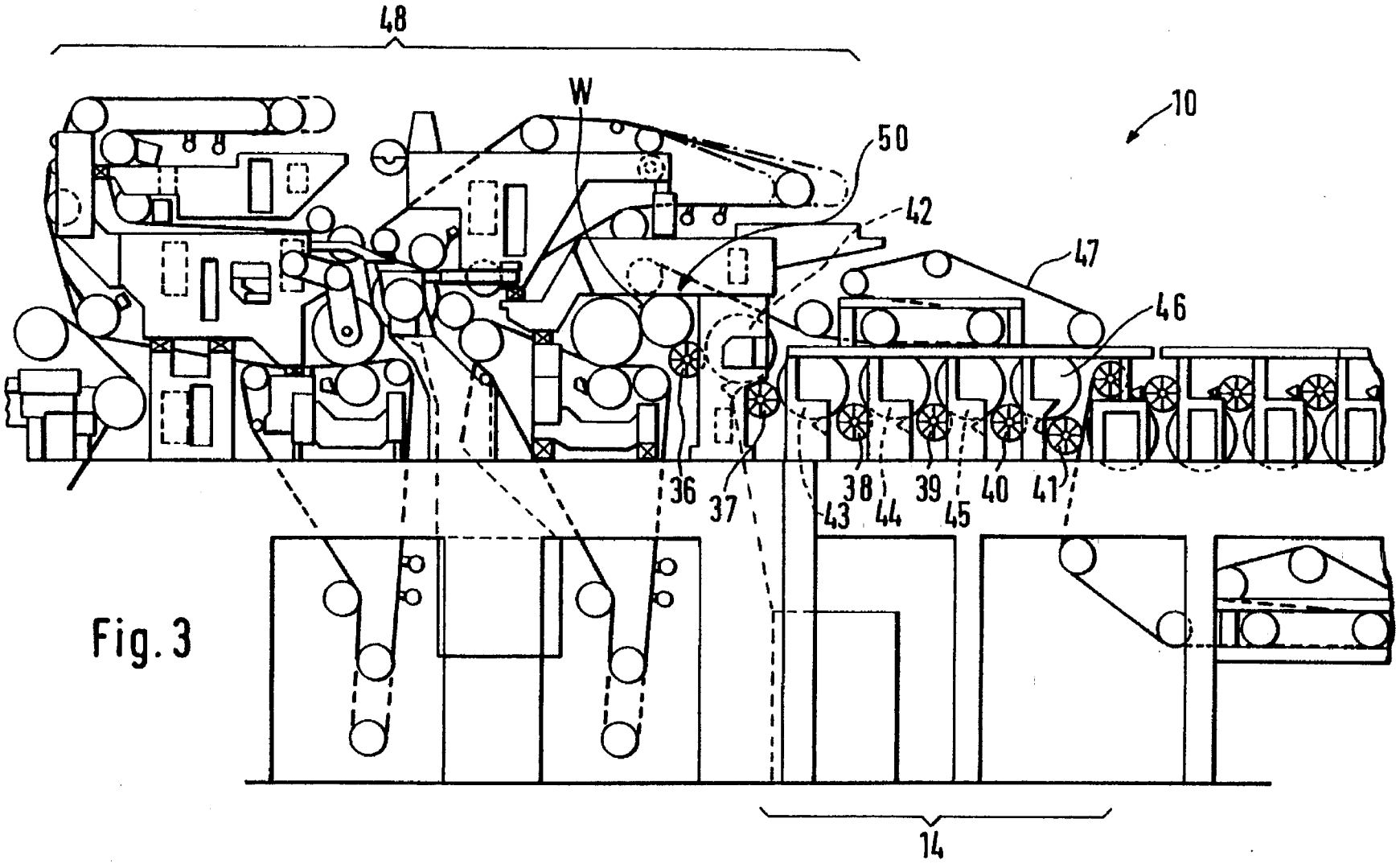
FIG. 3 is an enlarged view of the single-tiered dryer shown in FIG. 1.

FIG. 3 is an enlarged view of the single-tier dryer group 14 shown in FIG. 1. More specifically, FIG. 3 shows the first single-tier dryer group 14 which includes a plurality of vacuum transfer rolls 36, 37, 38, 39, 40 and 41. Each vacuum transfer roll of the plurality of vacuum transfer rolls 36 to 41 are disposed adjacent to a dryer 42, 43, 44, 45, and 46 of the first single tier dryer group 14 such that the web W extends in sinusoidal configuration alternately past a dryer and a vacuum transfer roll of the first single tier dryer group 14.

The first single tier dryer group 14 includes a dryer felt 47 such that the first single tier dryer group 14 is top felted, so that in the event of a web breakage, broke can be removed downwardly from the first single tier dryer group 14.

Additionally, as shown in FIG. 3, the on-line coater apparatus 10 includes a press section generally designated 48 disposed upstream relative to the dryer section 12. A dryer transfer means generally designed 50 is disposed between the press section 48 and the dryer section 12 for transferring the web W from the press section 48 to the dryer section 12. The dryer transfer means 50 includes the dryer felt 47

The further single-tier dryer group 20 shown in FIGS. 1 and 2 also includes a further felt 52 which extends in a sinusoidal configuration around the further single-tier dryer group 20 such that the further single-tier dryer group 20 is top felted.

As shown in FIGS. 1 and 2, the coater 28 includes a short-dwell coater 54.

The single-tier coating dryer group 32 also includes a coater felt 56 which extends in sinusoidal configuration around each dryer 58, 58', 59, 59', 60, 60', 61 and 62 of the single tier coating dryer group 32 such that the single-tier coating dryer group 32 is bottom felted.

More specifically, the single-tier coating dryer group 32 is disposed downstream relative to the coater 28 for drying the coated one-side 30 of the web W.

Additionally, a further single-tier coating dryer group generally designated 64 is disposed downstream relative to the single-tier coating dryer group 32, such that the coated web W extends in a further open draw 66 between the single-tier coating dryer group 32 and the further single-tier coating dryer group 64.

A further tail cutter means 67 is disposed adjacent to the further open draw 66 for cutting a further tail (not shown) from the web W for subsequent threading through the subsequent sections.

A further coater generally designated 68 is disposed downstream relative to the further single-tier coating dryer group 64 for coating a second side 70 of the web W.

More specifically, the further single-tier coating dryer group 64 includes a further coater felt 72 which extends in sinusoidal configuration around the further single-tier coating dryer group 64, such that the further single-tier coating dryer group 64 is top felted.

The further coater shown generally as 68 in FIG. 2 includes a short-dwell coater 74.

The on-line coater apparatus 10 also includes a plurality of single-tier coating dryer groups generally designated 76 and 78 disposed downstream relative to the further coater 68. Each successive coating dryer group 76 and 78 of the plurality of coating dryer groups 76, 78 dries an alternate side of the web W.

In operation of the apparatus according to the present invention, the web extends through the plurality of single tier dryer groups 14 to 19 without open draw, such that alternate sides of the web are successively dried.

The web then moves in open draw from the single tier dryer group 19 to the further single tier drying group 20, and a tail is cut from the web such that following sections of the machine can be threaded. The threaded web then extends through the calender 26 and thereafter through the coater 28 for coating one side of the web.

A further open draw exists between the single tier coating dryer group 32 and the further single tier coating dryer 64 such that the further tail cutter 67 cuts a further tail permitting threading of the further coater 68.

A third open draw exists between the coating dryer groups 76 and 78 such that a third further tail cutter 69 cuts a third further tail permitting the threading of a reel 79.

The present invention provides an on-line coater apparatus of compact configuration and reduce manufacturing costs. Also, the single-tier coating dryer groups overcome the problems associated with redundant dryers in the more conventional serpentine run arrangements.

What is claimed:

1. An on-line coater apparatus for coating a web of paper, said apparatus comprising:

a dryer section;

said dryer section including:

a plurality of single-tier dryer groups, each successive group drying alternate sides of the web, the web being restrained against cross-machine directional shrinkage during passage through said plurality of dryer groups;

a further single-tier dryer group disposed downstream relative to said plurality of groups such that the web extends in an open draw between said plurality of groups and said further group:

tail cutter means disposed adjacent to said open draw for cutting a tail from the web for subsequent threading through said further group;

calender means disposed downstream relative to said further group for calendering the dried web;

a coater disposed immediately downstream relative to said calender means for coating one side of the web;

a single-tier coating dryer group disposed downstream relative to said coater for drying said coated one side of the web;

a further single-tier coating dryer group disposed downstream relative to said single tier coating dryer group such that the coated web extends in a further open draw between said single-tier coating dryer group and said further single-tier coating dryer group;

a further tail cutter means disposed adjacent to said further open draw for cutting a further tail from the web for subsequent threading through said further single-tier coating group;

a further coater disposed downstream relative to said further single-tier coating dryer group for coating a second side of the web;

winding means disposed downstream relative to said further coater for winding the coated web:

said further single tier coating dryer group including:

a further coater felt extending in sinusoidal configuration around said further single-tier coating dryer group such that said further single-tier coating dryer group is top felted;

said further coater including:

a short-dwell coater; and said on-line coater apparatus further including:

a plurality of single-tier coating dryer groups disposed downstream relative to said further coater, each successive coating dryer group of said plurality of single-tier coating dryer groups drying an alternate side of the web.

2. An on-line coater apparatus as set forth in claim 1 wherein said plurality of single-tier dryer groups includes:

a first single-tier dryer group;

said first dryer group including:

a plurality of vacuum transfer rolls, each vacuum transfer roll of said plurality of vacuum transfer rolls being disposed adjacent to a dryer of said first single tier dryer group such that the web extends in sinusoidal configuration alternately past a dryer and a vacuum transfer roll of said first single tier dryer group.

3. An on-line coater apparatus as set forth in claim 2 further including:

a dryer felt cooperating with said first single tier dryer group such that said first single tier dryer group is top felted so that in the event of web breakage, broke can be removed downwardly from said first single tier dryer group.

4. An on-line coater apparatus as set forth in claim 1 further including:

a press section disposed upstream relative to said dryer section;

a dryer transfer means disposed between said press section and said dryer section for transferring the web from said press section to said dryer section;

said dryer transfer means including:

a dryer felt.

5. An on-line coater apparatus as set forth in claim 1 wherein said coater includes:

a short-dwell coater.

6. An on-line coater apparatus as set forth in claim 1 wherein said single-tier coating dryer group further includes:

a coater felt extending in sinusoidal configuration around each dryer of said coating dryer group such that said single-tier coating dryer group is bottom felted.

* * * * *